US006293090B1

(12) United States Patent
Olson

(10) Patent No.: US 6,293,090 B1
(45) Date of Patent: Sep. 25, 2001

(54) MORE EFFICIENT RF PLASMA ELECTRIC THRUSTER

(75) Inventor: Lynn B. Olson, Framingham, MA (US)

(73) Assignee: New England Space Works, Inc., Framingham, MA (US)

( * ) Notice: Subject to any disclaimer, the term of this patent is extended or adjusted under 35 U.S.C. 154(b) by 0 days.

(21) Appl. No.: 09/353,985

(22) Filed: Jul. 15, 1999

Related U.S. Application Data

(60) Provisional application No. 60/093,683, filed on Jul. 22, 1998.

(51) Int. Cl.[7] ..... H05H 1/00

(52) U.S. Cl. ..... 60/203.1; 313/231.31; 315/111.71

(58) Field of Search ..... 60/203.1; 315/111.21, 315/111.41, 111.71; 313/231.31

(56) References Cited

U.S. PATENT DOCUMENTS 5,592,055 * 1/1997 Capacci et al. ..... 315/111.21

OTHER PUBLICATIONS

*AIAA 2000–3756*, The Physics and Engineering of the VASIMR Engine, F. R. Chang Diaz, J. P. Squire, R. D. Bengtson, B. N. Breizman, F. W. Baity, M. D. Carter, Joint Propulsion Conference, Jul. 17–19, 2000, Huntsville, Alabama.

*J. Propulsion*, Vo. 12, No. 4, Whistler–Driven, Electron–Cyclotron–Resonance–Heated Thruster: Experimental status, B. W. Stallard and E. B. Hooper, 1996, pp. 814–816.

*Journal of Applied Physics*, vol. 46, No. 8, Electrostically driven overdense rf plasma source, Aug., 1975, pp. 3286–3292.

Plasma Acceleration by Electron Cyclotron Resonance, E. C. Hutter, H. Hendel, T. Faith, Radio Corporation of America, Princeton, NJ.

*AIAA 93–2108*, Experimental Studies of an ECR Plasma Thruster, D. A. Kaufman, D. G. Goodwin, 29th Joint Propulsion Conference and Exhibit, Jun. 28–30, 1993. Monterey, CA.

(List continued on next page.)

*Primary Examiner*—Timothy S. Thorpe
*Assistant Examiner*—Ehud Gartenberg
(74) *Attorney, Agent, or Firm*—Weingarten, Schurgin, Gagnebin & Hayes LLP

(57) ABSTRACT

A radio frequency (RF) plasma thruster for use in electric propulsion for spacecraft. The thruster operates by heating plasma in a magnetic field, which then flows out along magnetic field lines, producing axial thrust. The present invention greatly increases the efficiency of the RF plasma thruster compared to previous thrusters of this type, while retaining the advantages of RF plasma thrusters over other types of electric and chemical propulsion systems.

The present invention utilizes a lower hybrid wave for heating of the electrons, rather than electron cyclotron resonance (ECR) heating. The lower hybrid wave is used because it creates high-density plasmas and the antennas used to couple RF energy to the plasma are relatively simple to construct. This allows much better efficiency because no hot electron population is created to siphon off much of the RF power applied to the plasma. Lower hybrid waves propagate in the frequency range between the ion cyclotron frequency and the electron cyclotron frequency. The RF thruster of the present invention has a higher specific impulse than electrothermal thrusters, much higher power density than electrostatic ion thrusters, no life limiting grids or electrodes in contact with the plasma, and a simple geometry which is easily scaleable.

26 Claims, 4 Drawing Sheets

OTHER PUBLICATIONS

*Plasma Physics*, vol. 21, Penetration of Slow Waves Into An Overdense Plasma, R. W. Motley, S. Bernabei, W. M. Hooke, R. McWilliams and L. Olson, 1979, pp. 567–573.
Free, B. "Electric Propulsion for Near–Earth Sapcecraft" Launchspace, Oct.–Nov. 1999, pp. 28–19.*
Free, B. "Electric Propulsion for LEO Satellites" Launchspace, Apr. 2000, pp. 17–19.*
Free, B. "Electric Propulsion for GEO Satellites" Launchspace, May 2000, p. 20–22.*
Mariette DiChristina "Highway through Space" Popular Science, Nov. 1999, pp. 66–70.*
Cohen, S. and Paluzek, M., "The Grand Challenge" Launchspace, Dec. 1998, pp. 46–50 (?).*
Reader, P., "Ion Beam Sources, Past, Present and Future", Vacuum Technology & Coating, May 2000, pp. 24–31.*
Nickerson, R., "Plasma Surface Modification for Cleaning and Adhesion", Vacuum Technology and Coating, Jun. 2000, pp. 56(?)–61.*
Olson, L., "A More Efficient Radio Frequency Plasma Thruster" Paper AIAA–99–2437.*

* cited by examiner

MORE EFFICIENT RF PLASMA ELECTRIC THRUSTER

CROSS REFERENCE TO RELATED APPLICATIONS

This application claims priority under 35 U.S.C. §119 (e) to provisional patent application Ser. No. 60/093,683, filed Jul. 22, 1998, the disclosure of which is hereby incorporated by reference.

STATEMENT REGARDING FEDERALLY SPONSORED RESEARCH OR DEVELOPMENT

N/A

BACKGROUND OF THE INVENTION

Electric thrusters are known in the art. Unlike chemical propulsion, where the specific impulse is limited by the energy available when molecules combine, in electric propulsion energy is added from an external source. In principle, therefore, the specific impulse can be as large as desired. In practice, of course, the specific impulse is limited by the particular implementation used. Since thrust will decrease as the specific impulse increases for a given power, a tradeoff must be made for a particular mission between propellant usage and mission time. High specific impulse leads to low propellant usage.

The tradeoff between electric propulsion and chemical propulsion is high thrust, low specific impulse for chemical and low thrust, high specific impulse for electric. Electric thrusters cannot be used for launch because the thrust is too low. Electric thrusters can only be used in the vacuum of outer space.

The are three main types of electric thrusters: electrothermal, electromagnetic, and electrostatic.

Electrothermal thrusters are similar to standard chemical rocket engines. Electrical energy is added to the working gas, but the gas is expanded through a converging-diverging nozzle to achieve high exhaust speeds just as in chemical rockets. Some examples are the resistojet, the arc jet, and microwave heated thrusters. In the resistojet, gases already hot from burning are further heated electrically. The arc jet uses an electrical arc to create very high temperatures. More recently, microwaves have been proposed to do the heating of the gas in thrusters which are otherwise like arcjets. As a class, electrothermal thrusters are probably the most mature electric propulsion technology, although the individual thruster with the most operational experience is the Teflon ablative type. Resistojets have been used for many years, and arcjets have also been used over the past few years in operational, commercial communications satellites. Compared to other electric thrusters, electrothermal devices have higher thrusts, but lower specific impulse, in the range of 500–1000 seconds. They share with chemical rockets an optimization when the molecular weight of the exhaust gas is low, unlike other electric thrusters.

There are a variety of electromagnetic thruster configurations, but all depend on generating a thrust by accelerating particles in a direction perpendicular to both the current in the plasma and the magnetic field. The pulsed plasma microthruster (PPT) utilizes a spark discharge across a block of Teflon to create plasma which is accelerated outward by induced azimuthal current interacting with a radial magnetic field. In a Hall thruster an axial electric field provided in a radial magnetic field creates an azimuthal Hall current which accelerates plasma axially producing thrust.

In the self-field magnetoplasmadynamic (MPD) thruster, the current flow creates its own magnetic field in which the j×B force accelerates the plasma flow radially and axially. This can only occur if the current and hence the power are high, necessitating pulsed operation at lower average powers. Interestingly, the self-field MPD thruster is similar to the electrothermal arcjet. The MPD regime is reached when the mass flow is reduced.

In general, electromagnetic thrusters have much higher specific impulse than electrothermal thrusters do. They are more compact than electrostatic ion thrusters are because a charge neutral plasma does not have a space charge limitation on density. Problems include electrode erosion and general complexity of flow and current fields which make them somewhat difficult to predict. The PPT thruster is mature and simple, but harder to scale up to large powers.

Electrostatic ion thrusters use a set of grids to accelerate charged ions. Electrons are also expelled separately to maintain charge neutrality and prevent a charge buildup which could shut off the ion beam. Heavy gases are used; mercury was used in the initial versions and xenon is used today. This reduces ionization losses as a fraction of total energy. Ionization losses are approximately the same for most gases, whereas for a given exhaust velocity the energy added per ion is greater for heavier gases.

In electrostatic thrusters the beam consists of ions only and repulsion between particles limits the maximum density to relatively low levels. The electrostatic thruster offers significantly lower thrust than conventional RF plasma thrusters.

The prior use of RF plasma thrusters has suffered from poor efficiency due primarily to power loss through a hot electron population created by electron cyclotron resonance (ECR) heating of the plasma. The use of ECR has several disadvantages. The major disadvantage is the creation of a hot electron population that robs the thruster of power, leading to low efficiency. Other disadvantages include the ECR heating requires higher frequencies for a given set of plasma parameters than other RF heating schemes. Higher frequency RF sources are generally more expensive and less efficient. Additionally, the frequency and magnetic field must be precisely matched. Plasma densities are usually limited to less than the cutoff density for a given, frequency.

An ECR generated plasma contains populations of electrons with different temperatures. A hot population forms because of "runaway". Electron drag and collision cross section decrease as electron energy increases. Once an electron reaches a critical energy, it "runs away" because the drag can no longer balance the RF energy absorbed. An electron in resonance with the RF field essentially sees a continuous DC field, as the field rotates at the same rate as the electron as it spirals around the magnetic field line. The electron energy increases until some other process limits the energy. The ultimate limit for magnetic mirror machines occurs when the electron energy is high enough that the adiabatic invariant is no longer conserved and electrons are no longer trapped in the mirror. Hot electrons are generally produced by using twice the fundamental frequency, which is more effective at heating hotter particles.

In most of these devices there are particular reasons for producing the hot electron population. Hot electrons take almost all their energy with them when they are lost because their energies are so much greater than the plasma potential. They also tend to absorb more RF power than colder electrons. For a thruster, all the power entering the warm or hot electrons is simply wasted. All ECR plasmas on which there were diagnostics capable of observing hot electrons have shown split electron populations. Power balance calculations show that about 1% of the RF power was going into the cold plasma in the ECR plasma and somewhere between 50% and 100% of the RF went into the cold plasma in the lower hybrid generated plasma. It would be desirable to have a RF plasma thruster which has high efficiency, utilizes lower frequency RF sources than ECR heating, and does not suffer from hot electron runaway.

RF plasma thrusters are also simpler than electromagnetic thrusters, which generally have currents perpendicular to the magnetic field, which crossed with the magnetic field produces the thrust. The currents produce their own magnetic field, which in the worst case can go unstable. In any case, the current produces its own magnetic field which interacts with the imposed magnetic field. This makes scaling of devices to different sizes difficult. By contrast, in the RF plasma thruster each flux tube is like any other. The rapid axial transport of particles compared to radial movements means there is little interaction between flux tubes, so scaling up (or down) in size is very predictable.

It would be desirable to have a RF plasma thruster that does not suffer from poor efficiency while providing a high specific impulse, high power density and is adaptable to many different applications.

BRIEF SUMMARY OF THE INVENTION

A radio frequency (RF) plasma thruster for use in electric propulsion for spacecraft. The thruster operates by heating plasma in a magnetic field, which then flows out along magnetic field lines, producing axial thrust. The present invention greatly increases the efficiency of the RF plasma thruster compared to previous thrusters of this type, while retaining the advantages of RF plasma thrusters over other types of electric and chemical propulsion systems.

The present invention utilizes a lower hybrid wave for heating of the electrons, rather than electron cyclotron resonance (ECR) heating. The lower hybrid wave is a plasma wave having a frequency between ion and cyclotron frequencies. The lower hybrid wave has a component of electric field parallel to the magnetic field, so it can accelerate electrons moving along the field lines. The lower hybrid wave is used because it creates high-density plasmas and the antennas used to couple RF energy to the plasma are relatively simple to construct. This allows much better efficiency because no hot electron population is created to siphon off much of the RF power applied to the plasma. Lower hybrid waves propagate in the frequency range between the ion cyclotron frequency and the electron cyclotron frequency. The RF thruster of the present invention has a higher specific impulse than electrothermal thrusters, much higher power density than electrostatic ion thrusters, no life limiting grids or electrodes in contact with the plasma, and a simple geometry which is easily scaleable.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

A high efficiency RF plasma thruster is presented. The thruster utilizes a lower hybrid wave to heat the plasma in a magnetic field, causing the plasma to flow out along magnetic field lines providing axial thrust.

Figure 1:
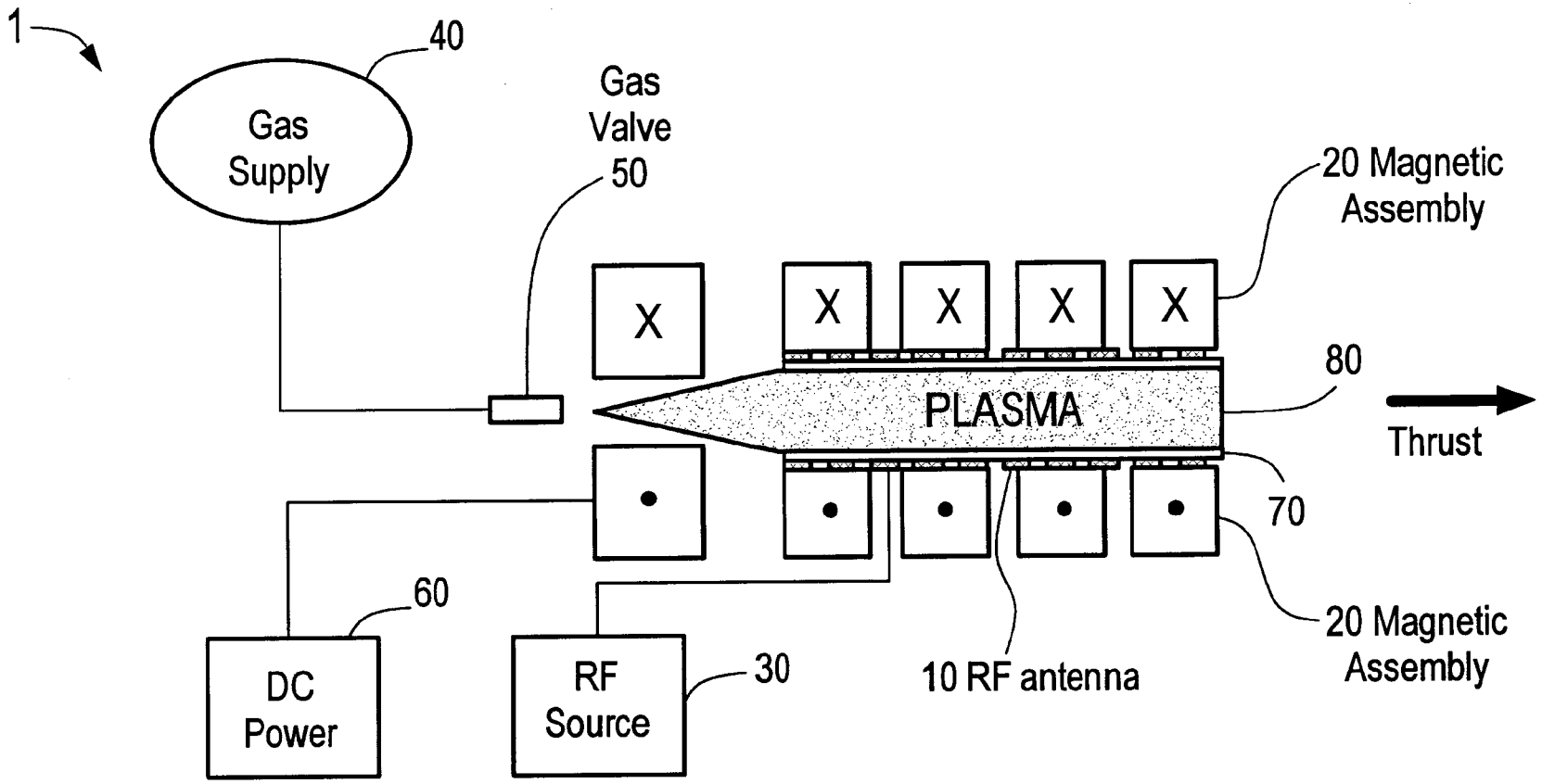
FIG. 1 is a diagram of the RF plasma thruster of the present invention.
Figure 2:
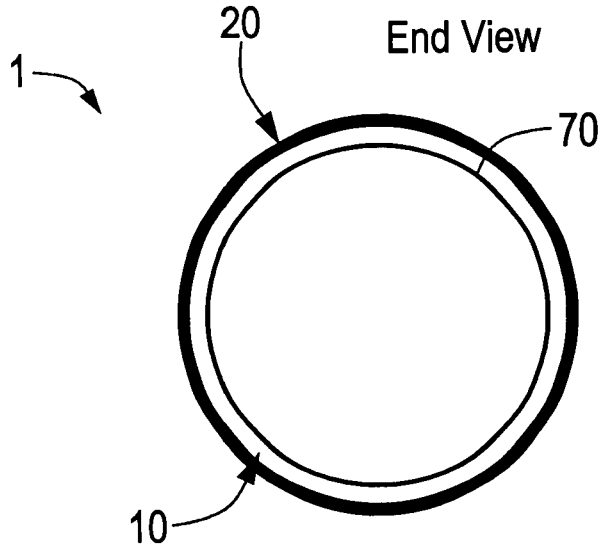
FIG. 2 is an end view of the RF plasma thruster of FIG. 1.
Figure 3:
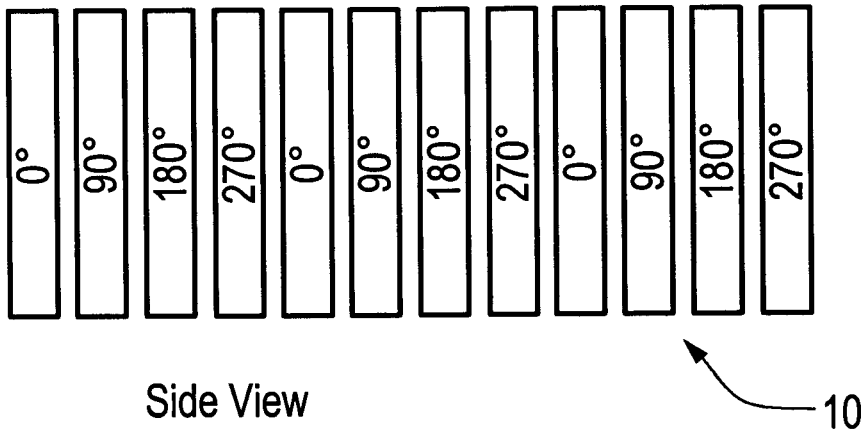
FIG. 3 is a side view of the antenna of FIG. 1.

The improved efficiency RF plasma thruster of the present invention is shown in FIGS. 1–3. The RF plasma thruster 1 includes a magnetic assembly 20 defining an area in which a gas from a gas supply 40 is excited to form a plasma 80. The plasma is contained within the magnetic field provided by the magnetic assembly. Antenna 10 surrounds the plasma and launched waves provided by the RF generator 30. A DC power supply is connected to and provides power to the magnetic assembly 20. A gas valve may be used to regulate the flow of gas entering the area defined by magnetic assembly 20.

In operation, gas from gas supply 40 is energized to provide a plasma 80. The plasma 80 in the magnetic field is heated by radio frequency (RF) excitation in the form of a lower hybrid wave. The heated plasma flows out of the thruster at the plasma sound speed, producing thrust. In the RF plasma thruster the plasma is completely ionized and the plasma leaves along magnetic field lines. Radial confinement is provided by the magnetic field, not the walls of the isolation tube 70. The lower hybrid wave is excited by rings of the antenna 10 around the plasma phased as shown in FIG. 3 to impose a parallel wavelength on the waves in the plasma. The rings of the antenna 10 are mounted on a quartz or Teflon tube 70 to prevent the antenna 10 from being in direct contact with the plasma 80. Outside the antenna 10 is a magnetic solenoid 20 to produce the axial magnetic field.

Table 1 contains the parameters of the RF plasma thruster.

TABLE 1

| Thruster Parameters | |
|---|---|
| Working Gas | Argon |
| RF Frequency | 300 MHz |
| Magnetic Field | 500 Gauss |
| Electron Cyclotron Frequency | 1400 MHZ |
| Ion Cyclotron Frequency | 19 MHz |
| Free Space Wavelength | 100 cm |
| Lower Hybrid Wave Wavelength | 2 cm (n parallel = 50) |
| Density limit | $1.5 \times 10^{13}$ cm$^{-3}$ |
| Nominal Density | $1.0 \times 10^{13}$ cm$^{-3}$ |
| Electron Temperature | 35 eV |
| Ion energy (plasma space potential) | 175 eV |
| Exhaust Velocity | 28.9 km/sec<br>Isp = 2945 seconds |
| Plasina Diameter | 2 cm |
| Power | 3.2 kW |

Argon is utilized to give the right specific impulse at reasonable plasma potential. A heavier gas, such as xenon, is often used in electric thrusters at higher voltage to increase the ratio of ion energy to ionization losses. However, in this case, higher electron temperature would be required, negating this advantage. The ionization (frozen flow) losses are actually similar to those in the xenon electrostatic thruster because the magnetic field reduces ionization losses. Other gases, noble or reactive, could also be used. For example, argon, xenon, hydrogen, oxygen, or krypton.

The frequency provided by the RF source is chosen to be between 10 MHz and 2 GHz and preferably approximately 300 MHz. Higher frequencies require higher magnetic field, but result in a denser plasma and more compact device. Lower frequency RF amplifiers are cheaper and more efficient. An RF frequency of approximately 300 MHz is a good compromise for a stand-alone device. It also falls in the middle of the UHF band, so an RF transmitter could be shared between propulsion and communications with a switch, e.g. a PIN diode. An S-band thruster could also be designed to share power between communications and propulsion without too much change in the design. For X-band, it would be desirable to use waveguide antennas rather than rings. Again, unless there is a desire to share RF power between communications and propulsion, higher frequencies such as S and X band would not be used because of the somewhat greater difficulty in generating RF power and the higher magnetic field required. However, sharing power may result in significant overall weight and cost savings.

The magnetic field may be between 100 Gauss for small thrusters and several thousand Gauss when superconducting magnets are used. Preferably a magnetic field of approximately 500 Gauss is chosen so the frequency used falls well in between the electron and ion cyclotron frequencies. As with the RF frequency, lower fields result in lower cost and higher fields support higher density, leading to a more compact device.

The parallel index of refraction of the lower hybrid wave is chosen largely to achieve the desired density. Another major consideration is absorption within the plasma Higher n parallel waves are absorbed more quickly. If the absorption is too high, the wave will heat only the surface of the plasma, while if it is too low the wave can cross the plasma without being completely absorbed. The lower hybrid wave has a wavelength between 0.067 centimeters and 13.33 centimeters, and preferably 2 centimeters.

The electron temperature can be between 20 eV and 100 eV. Preferably an electron temperature of approximately 35 eV is used and is a factor entering into controlling the plasma potential and hence the ion energy and specific impulse. For a fully ionized plasma, it is controlled by the ratio of RF power to density. The potential is typically 3–6 times the electron temperature. The potential/temperature ratio has been chosen to be five, which is a fairly typical value.

The plasma has a diameter between 1 centimeter and 20 centimeters, and preferably of approximately 2 centimeters. The thruster produces an exhaust velocity of between 10 kilometers per second and 50 kilometers per second, and preferably approximately 28.9 kilometers per second. The thruster provides between 10 watts and 30 megawatts of power and in the preferred embodiment 3.2 kilowatts.

The slow lower hybrid wave utilized by the present RF electric thruster is launched into a plasma by imposing an oscillating electric field along the magnetic field lines. Since the lower hybrid wave is not resonant, electrons in their own frame still see an oscillatory field and runaway does not develop. The wavelength parallel to the magnetic field is imposed by the launching structure, such as an antenna. The parallel wavelength must be shorter than the free space wavelength for the wave to propagate in the plasma. Thus, the wave cannot propagate in vacuum or plasma of less than critical density (critical density is where the plasma frequency is equal to the RF frequency). Unlike electron cyclotron heating in which density is limited to below cutoff, for the RF plasma thruster the density must be above cutoff.

Figure 4:
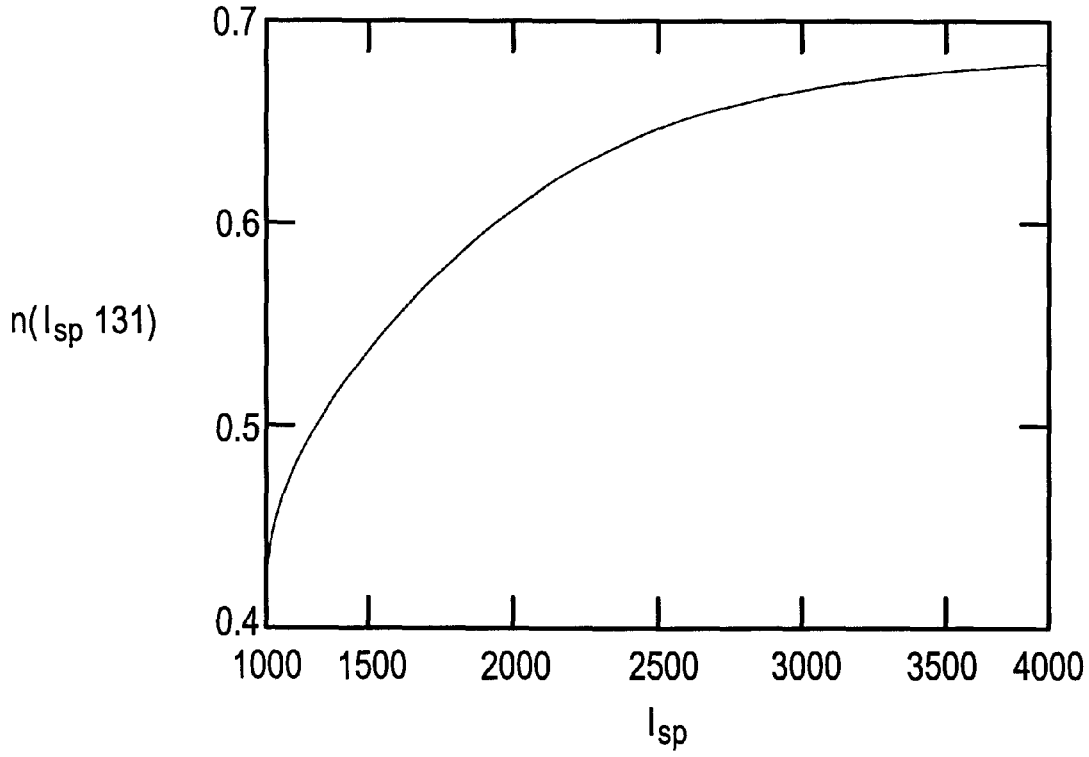
FIG. 4 is a graph showing RF plasma thruster efficiency versus specific impulse.

Referring now to FIG. 4, a graph showing the RF plasma thruster versus specific impulse is shown. The present invention greatly increases the efficiency of the RF plasma thruster compared to previous thrusters of this type, while retaining the advantages of RF plasma thrusters over other types of electric and chemical propulsion systems. The lower hybrid wave is used because it creates high-density plasmas and the antennas used to couple RF energy to the plasma are relatively simple to construct. This allows much better efficiency because no hot electron population is created to siphon off much of the RF power applied to the plasma. Lower hybrid waves propagate in the frequency range between the ion cyclotron frequency and the electron cyclotron frequency.

The RF plasma thruster is basically a thermal device, with the plasma being heated by RF and producing axial thrust as it flows out. High specific impulse is derived from the high electron temperature. For example, a 50 eV electron temperature plasma corresponds to a temperature of over half a million degrees Kelvin. Magnetic insulation from the walls allows such high temperatures, as in experimental fusion devices where temperatures on the order of one hundred million degrees Kelvin have been achieved. However, it is important to understand the details of how the thermal energy is translated into axial thrust in order to optimize the thruster characteristics.

The RF acts on the electrons. Ions are heated only via collisions with electrons. Since electrons are so much lighter than the ions (over a factor of 200,000 for xenon), this is a very slow process. Momentum is conserved in collisions, so the velocity and hence energy imparted to ions by electrons is very slight. Unless the density is very high, ions tend to stay relatively cool. In fact the ions stay close to room temperature (0.025 eV) in laboratory plasmas with parameters similar to those desired in a thruster.

Figure 5:
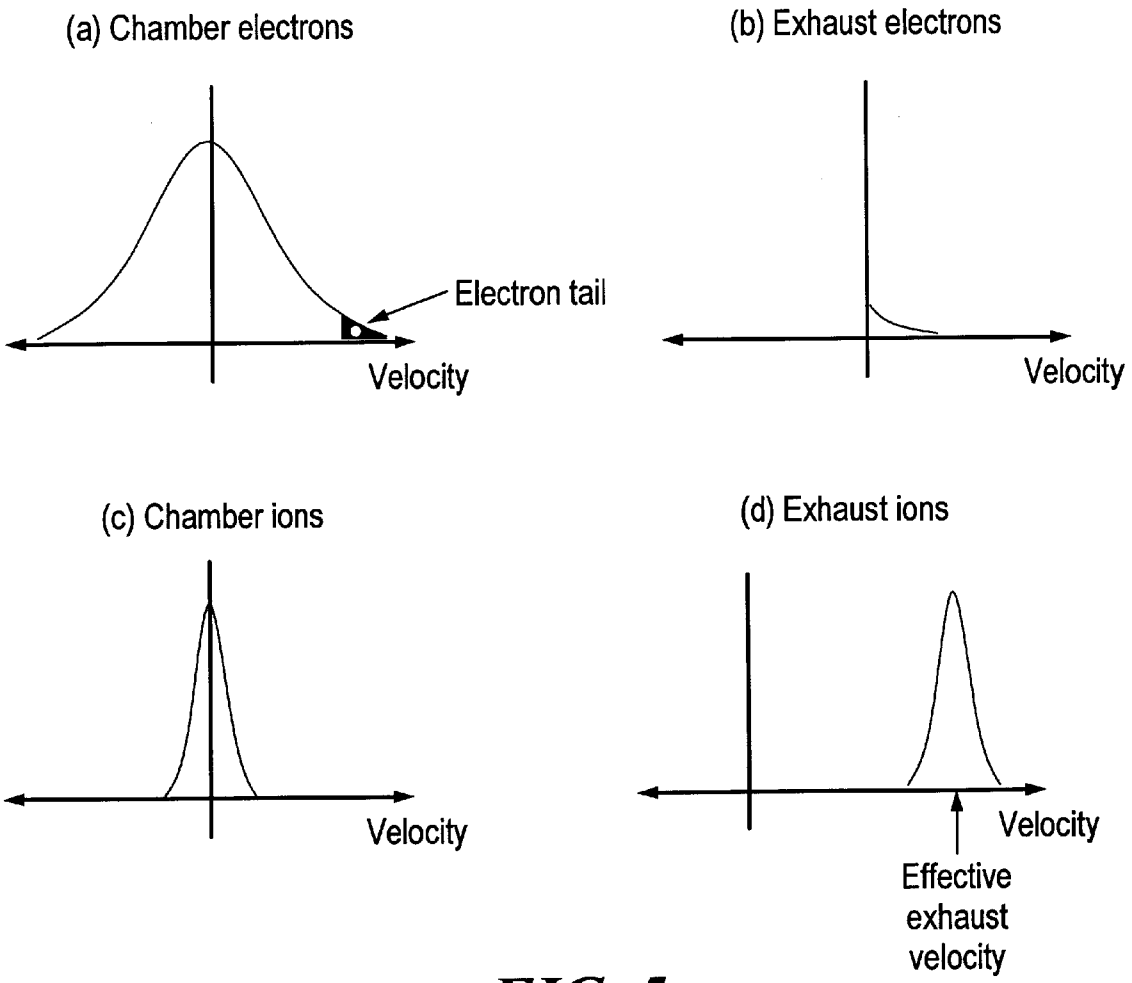
FIG. 5 is a series of graphs showing electron and ion distributions for the RF plasma thruster.

In the main plasma (equivalent to rocket combustion chamber) there exists a population of electrons and ions with different temperatures. Partly due to this temperature difference, but mainly due to the tremendous mass difference, the electron thermal velocity is much greater than the ion thermal velocity. For example, in xenon with an electron temperature of 20 eV and ion temperature of 1 eV, the respective thermal velocities are $2.7\times10^8$ cm/sec and $1.2\times10^5$ cm/sec, a factor of more than 2,000. If both flowed out at these speeds, a tremendous positive potential would build up as many more ions than electrons would be left behind. To maintain quasineutrality, or roughly equal numbers of electrons and ions, a potential builds up to accelerate the ions and retard the electrons. Most of the electrons are electrostatically trapped, while the ins are driven out by the positive potential. Equilibrium is reached when the flux due to the "tail" of electrons above the potential is equal to the ion flux as is shown in FIG. 5. If the electrons are collisional, the exhaust velocity distribution will form into a Maxwellian, as opposed to the "tail" distribution shown in graph c of FIG. 5. In either case, the electrons are cooled. The ions form a "beam" distribution, maintaining their original relative velocity distribution but shifted to a positive velocity. This can be compared to the expansion in a chemical rocket nozzle where the entire gas is cooled in the nozzle, producing thrust.

The RF plasma thruster of the present invention has higher specific impulse than electrothermal thrusters. Unlike electromagnetic thrusters, there are no electrodes in contact with the plasma or large currents perpendicular to the magnetic field. Wall interactions are less, reducing energy and particle losses and sputtering of wall material. The lack of large perpendicular currents means the physics is much simpler and easier to scale to different size devices. The RF plasma thruster shares with electromagnetic thrusters the capability for high power density.

The plasma thruster is not a confinement device. The plasma must be expelled for it to operate. A problem with confinement devices is "bad" curvature of the magnetic field lines, creating magnetohydrodynamic (MHD) instabilities which fling the plasma into the walls. A straight solenoid is neutral with respect to stability and "good" curvature can be provided if desired. The fact that axial confinement is not desired or attempted makes thrusters much, much simpler than confinement devices.

The RF plasma thruster of the present invention has a higher specific impulse than electrothermal thrusters, much higher power density than electrostatic ion thrusters, no life limiting grids or electrodes in contact with the plasma, and a simple geometry which is easily scaleable.

The RF plasma thruster is particularly well suited for certain applications. The design life of communications satellites is often limited by the amount of propellant on board, so the high specific impulse of electric propulsion is an advantage achieved with the RF plasma thruster. Less propellant can lead to either a lighter, cheaper to launch spacecraft or more revenue producing transponders on board. The presently disclosed RF plasma thruster has the added advantage of the possibility of using the communications amplifiers for the thruster, greatly reducing the additional power processing required for the thruster.

Some additional applications are spacecraft station keeping, attitude control, maneuvering, orbit raising, and interplanetary missions. Because interplanetary missions take months to years, the low thrust provided by electric thrusters has plenty of time to act. Mission analyses show that in many cases mission times as well as propellant usage is lower for electric propulsion. For station keeping the utility is also desirable, since the thrust required is low and low propellant usage is very desirable for satellites that may be in use for up to fifteen years. Raising satellites from low earth orbit to geostationary orbit can take many months compared to a day or so (depending on when orbit changes are made) for chemical rockets. In addition to the loss of time, the spacecraft will spend a greater amount of time in regions of greater radiation intensity. However, it may still be worthwhile, particularly if the spacecraft can be moved to a smaller and cheaper launch vehicle because of the reduced propellant need. The need afor high electric power on orbit would also enhance the case for electric, since the thruster and payload could use the same power source. In the longer term, tethers combined with electric propulsion could provide most of the speed of chemical with lower propellant usage than electric alone. This last is because the power source does not need to be lifted to a higher orbit, but rather can be left with the tether.

Having described preferred embodiments of the present invention it should be apparent to those of ordinary skill in the art that other embodiments and variations of the presently disclosed embodiment incorporating these concepts may be implemented without departing from the inventive concepts herein disclosed. Accordingly, the invention should not be viewed as limited to the described embodiments but rather should be limited solely by the scope and spirit of the appended claims.

I claim:

1. A high efficiency RF plasma thruster comprising:

an RF generator for generating RF energy at a frequency f and a power P;

a lower hybrid wave launching structure coupled to said RF generator, said wave launching structure comprised of plural radiating elements;

a tube disposed within said wave launching structure, said tube defining an area within said wave launching structure and having a central axis of symmetry;

a magnetic assembly disposed about said wave launching structure for establishing a magnetic field substantially parallel to said central axis of symmetry;

a power supply coupled to said magnetic assembly for energizing said magnetic assembly; and a gas supply in fluid communication with and supplying gas at a rate r to said area defined by said tube, the gas within said area being excited by said RF energy emitted by said lower hybrid wave launching structure to provide a plasma including a lower hybrid wave which provides thrust having a specific impulse determined by the ratio of P to r, wherein each of plural said radiating elements is disposed in a respective plane substantially perpendicular to said central axis of symmetry, wherein said plural radiating elements are collectively disposed about said central axis of symmetry in a staggered array substantially parallel and along the lenght of said central axis of symmetry, wherein a time-varying electric signal is provided by said RF generator to each of said radiating elements, the time-varying electric signal provided to one of said plural radiating elements being out of phase with the time-varying electric signal provided to an adjacent one or ones of said plural radiating elements, and whereby said lower hybrid wave launching structure imposes a wavelength, determined by the phasing $\phi$ between adjacent ones of said plural radiating elements, substantially parallel to said magnetic field and said central axis of symmetry on waves in said plasma, said imposed wavelength satisfying the equation:

$$\left(\frac{d}{\lambda}\right)\left(\frac{360}{\phi}\right) \leq \frac{\omega_{ce}}{2\omega_{pe}}$$

where d is the distance between adjacent ones of said plural radiating elements, $\lambda$ is the free space wavelength at an imposed frequency f, $\omega_{ce}$ is the electron cyclotron frequency, $\omega_{pe}$ is the electron plasma frequency, and $\phi$, the phase difference between adjacent ones of said plural radiating elements, is measured in degrees.

2. The thruster of claim 1 wherein said time-varying electric signal is a regular sinusoid and wherein said plural radiating elements of said wave launching structure have a pitch therebetween substantially defined by the quantity 0.25 times the quantity (1/f).

3. The thruster of claim 1 wherein said gas comprises a noble gas.

4. The thruster of claim 1 wherein said gas comprises a reactive gas.

5. The thruster of claim 1 wherein said gas is selected from the group consisting of argon, xenon, hydrogen, oxygen and krypton.

6. The thruster of claim 1 wherein an RF frequency provided by said RF generator comprises a frequency between approximately 10 MHz and approximately 2 GHz.

7. The thruster of claim 1 wherein an RF frequency provided by said RF generator comprises approximately 300 MHz.

8. The thruster of claim 1 wherein said magnetic assembly provides a magnetic field having a strength between approximately 100 Gauss and approximately 5000 Gauss.

9. The thruster of claim 1 wherein said magnetic assembly provides a magnetic field having a strength of approximately 500 Gauss.

10. The thruster of claim 1 wherein a frequency of said plasma is approximately equal to an RF frequency provided by said RF generator.

11. The thruster of claim 1 wherein said lower hybrid wave has a wavelength between approximately 0.067 centimeters and 13.33 centimeters.

12. The thruster of claim 1 wherein said lower hybrid wave has a wavelength of approximately 2 centimeters.

13. The thruster of claim 1 wherein an electron temperature comprises a temperature between approximately 20 eV and approximately 100 eV.

14. The thruster of claim 1 wherein an electron temperature comprises approximately 35 eV.

15. The thruster of claim 1 wherein an exhaust velocity comprises between approximately 10 kilometers per second and approximately 50 kilometers per second.

16. The thruster of claim 1 wherein an exhaust velocity comprises approximately 28.9 kilometers per second.

17. The thruster of claim 1 wherein said plasma has a diameter between approximately 1 centimeter and approximately 20 centimeters.

18. The thruster of claim 1 wherein said plasma has a diameter of approximately 2 centimeters.

19. The thruster of claim 1 wherein said thruster provides between approximately 10 watts of power and approximately 30 megawatts of power.

20. The thruster of claim 1 wherein said thruster provides approximately 3.2 kilowatts of power.

21. The thruster of claim 1 wherein said RF generator provides a S-band frequency signal.

22. The thruster of claim 1 wherein said RF generator provides an X-band frequency signal.

23. The thruster of claim 1 wherein said wave launching structure comprises a ring antenna.

24. The thruster of claim 21 wherein said wave launching structure comprises a wave guide antenna.

25. The thruster of claim 1, wherein the electron temperature of said plasma is equal to or greater than 20 eV.

26. The thruster of claim 1, wherein said RF generator and said lower hybrid wave launching structure produces a plasma potential within said plasma, said plasma potential determining the ion energy of the thruster exhaust.

* * * * *

UNITED STATES PATENT AND TRADEMARK OFFICE

CERTIFICATE OF CORRECTION

PATENT NO. : 6,293,090 B1
DATED : September 25, 2001
INVENTOR(S) : Lynn B. Olson It is certified that error appears in the above-identified patent and that said Letters Patent is hereby corrected as shown below:

Column 4,
Table 1, line 58, "Plasina" should read -- Plasma --;

Column 6,
Line 53, "ins" should read -- ions --; and

Column 7,
Line 51, "afor" should read -- for --.

Signed and Sealed this

Second Day of July, 2002

*Attest:*

*Attesting Officer*

JAMES E. ROGAN
*Director of the United States Patent and Trademark Office*